US005524536A

United States Patent [19]

Moizeau

[11] Patent Number: 5,524,536

[45] Date of Patent: Jun. 11, 1996

[54] PRINT MECHANISM ENABLING MAIL CARRIERS TO BE DISTINGUISHED

[75] Inventor: Gerard Moizeau, Lonjumeau, France

[73] Assignee: Neopost Industrie, Bagneux, France

[21] Appl. No.: 478,841

[22] Filed: Jun. 7, 1995

Related U.S. Application Data

[63] Continuation of Ser. No. 174,043, Dec. 28, 1993, abandoned.

[30] Foreign Application Priority Data

Dec. 30, 1992 [FR] France ..... 92 15937

[51] Int. Cl.[6] ..... B41L 47/46

[52] U.S. Cl. ..... 101/91; 235/101; 101/110

[58] Field of Search ..... 101/45, 91, 92, 101/93, 93.2, 93.21, 99, 106, 109, 110; 235/101

[56] References Cited

U.S. PATENT DOCUMENTS 4,519,311 5/1985 Lowe ..... 101/109

5,024,153 6/1991 Bannister et al. ..... 101/91

5,079,712 1/1992 Ileana et al. ..... 346/464.03

FOREIGN PATENT DOCUMENTS 30 17 088 11/1981 Germany .

90/16047 12/1990 WIPO .

*Primary Examiner*—Christopher A. Bennett

*Attorney, Agent, or Firm*—Sughrue, Mion, Zinn, Macpeak & Seas; Richard C. Turner; Joseph J. Buczynski

[57] ABSTRACT

The present invention relates to the specific field of processing mail. More particularly, it relates to a print mechanism enabling a ail carrier to be recognized from the franking print applied to an article of mail, the carrier having been previously selected by the user of the postage meter. The device for selecting articles of mail as a function of carrier or of shipping service consist in printing a special mark on each article of mail as a function of the corresponding carrier.

6 Claims, 3 Drawing Sheets

ACCOUNTING DEVICE
REG. P
REG. L
INTERFACE
KEYPAD
1
2
3
4
5
11
12
13
14
P
Q

PRINT MECHANISM ENABLING MAIL CARRIERS TO BE DISTINGUISHED

This is a continuing application of application Ser. No. 08/174,043, filed Dec. 28, 1993 abandoned.

BACKGROUND OF THE INVENTION

1. Field of the Invention

The present invention relates to the specific filed of mail processing. More particularly it relates to a print mechanism enabling the user of a postage meter ("franking machine") to select a particular carrier for mail and enabling the carrier to be recognized from the franking imprints applied to an article of mail.

2. Description of the Related Art

So far as we know, the sate of the art does not include any selection means enabling an operator to identify the carrier by means of the franking imprints printed on an article of mail, other than by allocating a particular postage meter to each carrier or shipping service.

SUMMARY OF THE INVENTION

It is on the basis of that technical problem that, according to an essential feature of the invention, the Applicant proposes specially marking each article of mail as a function of the corresponding carrier.

This facilitates breaking down of all franking operations as a function of mail shipping service, while using a single mail processing machine. An account number is then allocated to each shipping service in order to avoid any accounting errors.

According to another feature of the invention, this marking that is suitable for being selected by the user of the postage meter, is obtained by any protected print means, e.g., a rotary drum having printing plates, and under electronic control, to print a plurality of selectable distinctive marks.

According to another feature, the specific mark is printed on a determined location of the article of mail, preferably in the immediate proximity of a multipurpose franking imprint.

According to another feature, the printed drum prints said specific mark by means of a pivoting printing plate.

According to another feature, the print drum prints said specific mark by means of a print wheel.

According to another feature, the print wheel prints said specific mark by a special control device such as a hinged rocker or a cam shaft.

Other features and advantages of the invention appear more clearly from the following description accompanied by three sheets of drawings.

DETAILED DESCRIPTION OF THE PREFERRED EMBODIMENTS

Figures 1, 2, 3, 4:
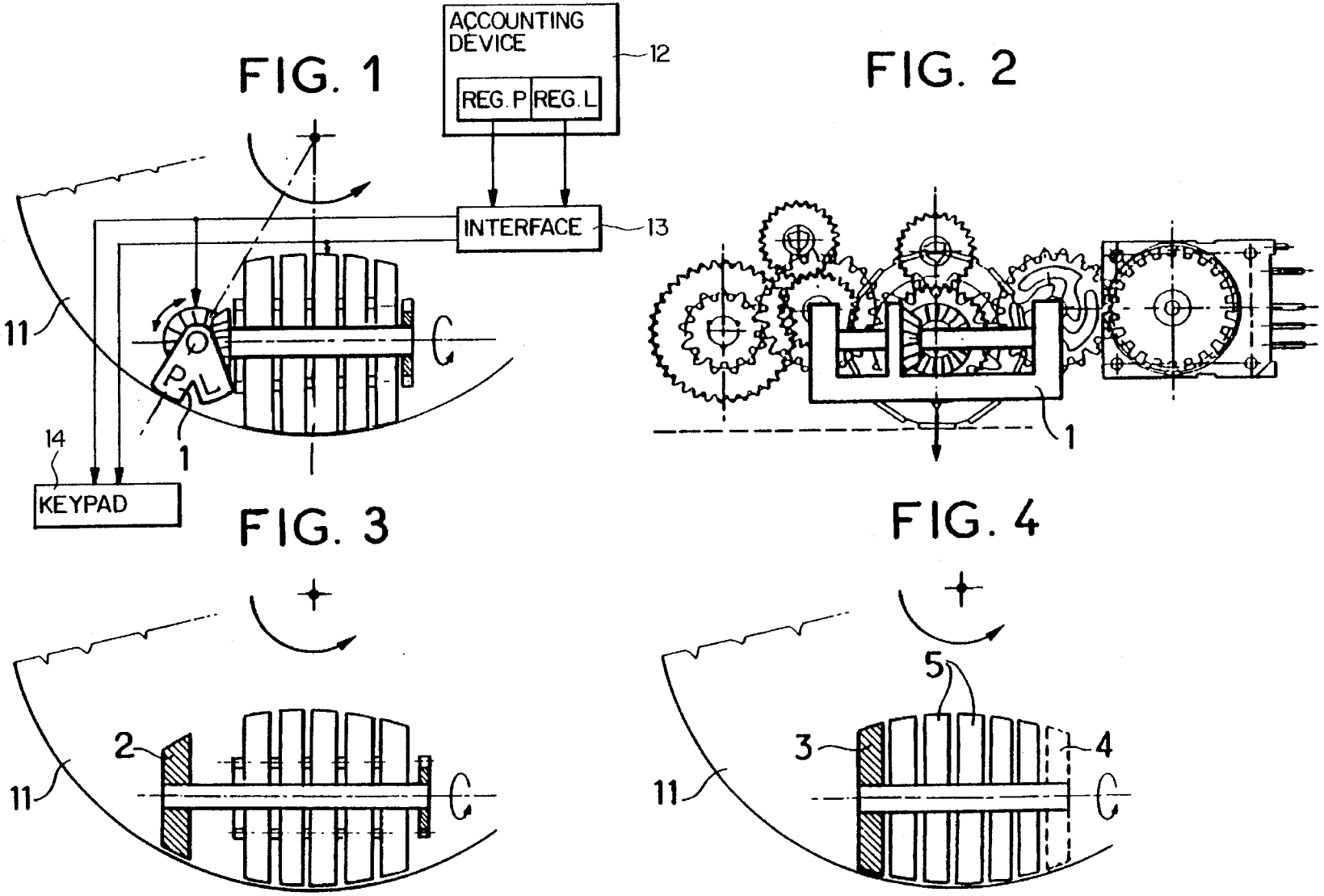
FIGS. 1 to 8 show different embodiments of a marking device in accordance with the invention.
Figure 9:
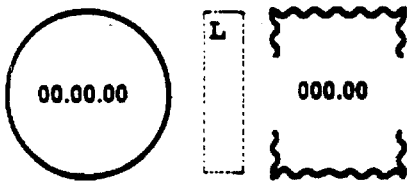
FIGS. 9 to 16 show examples of prints obtained using such devices.
Figure 10:
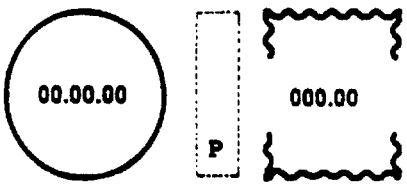

As shown in FIGS. 1 and 2, a pivoting printing plate 1 can be used that has two positions corresponding to two different services. The print obtained is shown in FIGS. 9 and 10. This solution provides two possible choices at any height within the zone outlined by a dotted line. The mark is represented by the letter L or the letter P.

Figure 11:
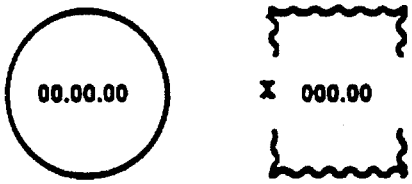

As shown in FIG. 3, it is possible to insert a print wheel 2 enabling as many different postal services to be specified as there are locations for receiving printing blocks. The printing obtained is shown in FIG. 11. This solution makes five to nine choices possible for the mark that is symbolized by the letter X.

Figure 12:
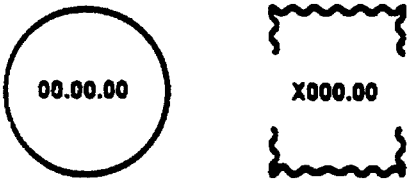
Figure 13:
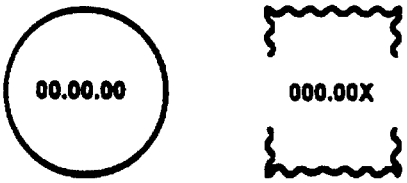

As shown in FIG. 4, a print wheel 3 or 4 may be disposed adjacent to the monetary value print wheels 5, thereby service to specify as many postal services as there are locations for receiving print blocks. This print wheel may be disposed in the first position or the fourth position relative to a set of three monetary value wheels, or in the first position or the fifth position relative to a set of four monetary value print wheels, or in the first position or the sixth position relative to a set of five monetary value print wheels, . . . . The resulting print is shown in FIGS. 12 and 13. In any of these cases, this solution makes five to nine choices possible.

Figure 5:
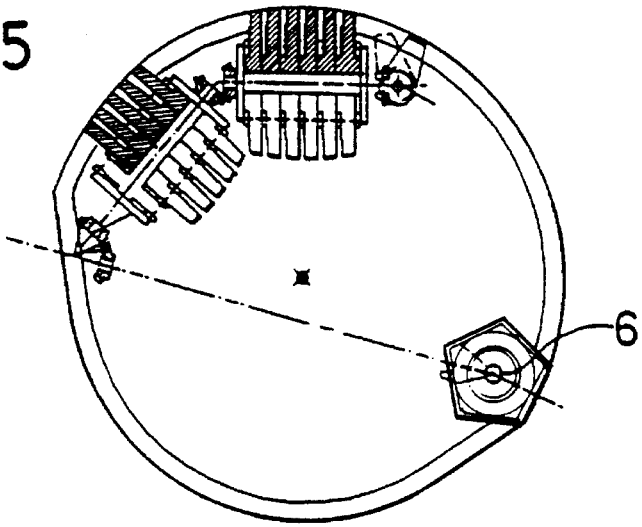
Figure 14:
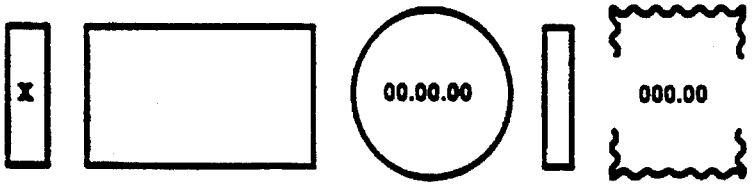

In another embodiment, as shown in FIG. 5, a five-flat device 6 referred to as a "pentagon" enables five different postal services to be specified. The resulting print is shown in FIG. 14. This solution provides five choices for the mark that is represented by the letter X.

It is also possible to implement special control

Figure 6:
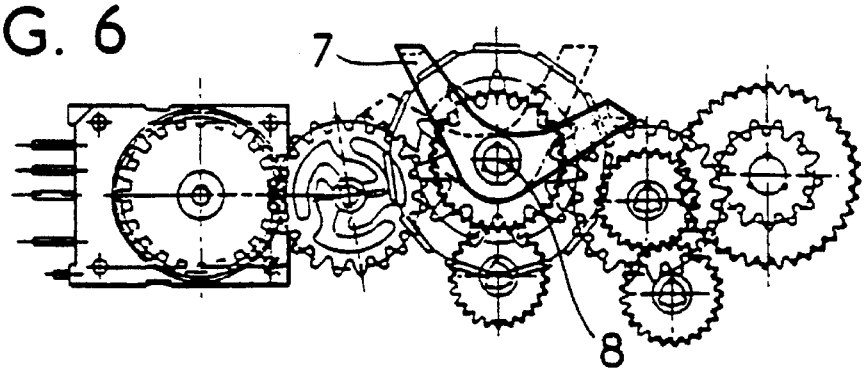

As shown in FIG. 6, a rocker 7 is hinged on the same shaft 8 as the print wheels and is itself actuated by a gear wheel, as are the print wheels, thereby enabling one or other of two marks corresponding to the selected service to be printed either above or below the value of the franking within the "stamp".

Figure 7:
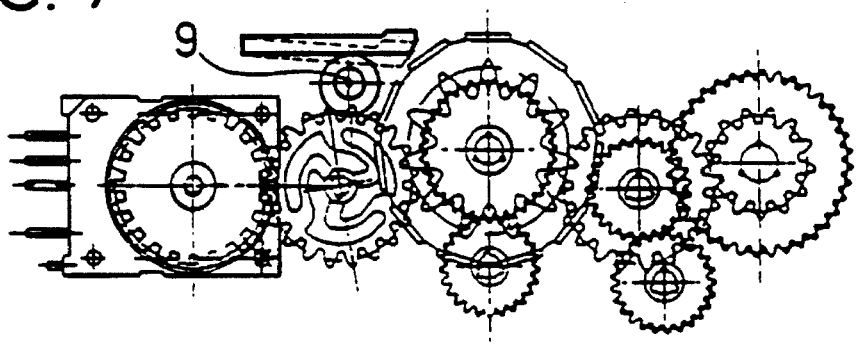
Figure 8:
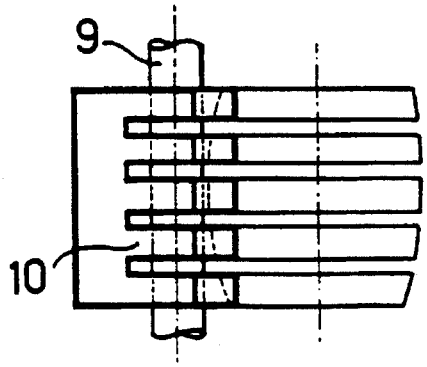

As shown in FIG. 7 and 8, a cam shaft 9 driven by a gear wheel, lifts in alternation one printing plate 10 selected from five, thereby printing a mark above or below the franking value inside the "stamp" and corresponding to the selected service.

Figure 15:
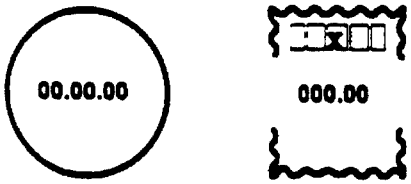
Figure 16:
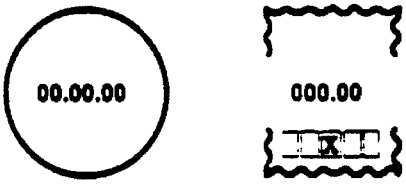

Printers as obtained with the latter two embodiments are shown in FIG. 15 and 16. In each case, five choices are possible, each in a different location.

Such print means make it possible to distinguish the franking prints on objects that are to be shipped by different postal services, e.g., letters that are to be shipped by a private carrier.

Using the keypad of the postage meter, the user can select the service whereby the object is to be shipped.

This require franking prices to be accounted for in a register corresponding to the selected service.

This requires a mark identifying the selected service to be printed. The print means and the accounting means are protected by seals.

This mark (alphanumerical characters, logo, etc.) can be printed anywhere within the print by various mechanical means enabling a selection to be made from a minimum of two postal services, or more depending on the means used.

Specifically, FIG. 1 illustrates an apparatus, such as a postage meter or the like, for selecting articles of mail according to an embodiment of the present invention. This apparatus includes a printing device (e.g., print wheels 5, as shown in FIG. 5) which prints a postage amount on a mail article. The apparatus further includes an additional printing element 1 which prints one of a plurality of selectable marks on the mail article. The plurality of selectable marks respectively identify shipping services. Hence, the mark printed on the mail article by the additional printing element 1 identifies a specific shipping service for the mail article.

The apparatus also includes an accounting device 12 that comprises a plurality of selectable registers P and L. The accounting device 12 is connected to the printing device and additional printing element by a standard interface 13, such as that described in U.S. Pat. Nos. 4,914,606 and 4,931,943 which are incorporated herein by reference in their entirety. This standard interface 13 includes a processor consistent with those found in all electronic printing heads (see U.S. Pat. Nos. 4,914,606 and 4,931,943).

As indicated, the P and L registers correspond to the shipping services and operate in conjunction with the printing device and additional printing element to account for the postage amount of the mail article based on what shipping service has been identified and thus printed on that article by the additional printing element.

For example, if the additional printing element has printed a "P" on the mail article indicating that that mail article is to be shipped by "P" shipping service, then the P register in the accounting device will register the postage amount printed on that mail article by the printing device. Alternatively, if the additional printing element has printed an "L" on the mail article indicating that that mail article is to be shipped by "L" shipping service, then the L register in the accounting device will register the postage amount printed on that mail article by the printing device. Of course, both of these registers could be designed to accumulate the total postage amounts for the shipping services for a predetermined period (e.g., the P register could keep a cumulative total of the amount of postage shipped by "P" shipping service over a given period while the L register could keep a cumulative total of the amount of postage shipped by "L" shipping service over a given period).

The apparatus further includes a keypad 14, such as a conventional keypad having numbers, letters, symbols and the like. The keypad 14 is coupled the interface 13, printing device and additional printing element to control, for example, the position of the additional printing element. Hence, an operator, for example, by manipulating the keypad 14, can set the additional printing device to print either a mark indicating the "P" shipping service on the mail article or a mark indicating the "L" shipping service on the mail article. The processor in the interface 13 is programmed to monitor the keypad 14 so as to control the P and L registers of the accounting device to register the postage amount for their corresponding shipping service when that shipping service is selected by the keypad. The keypad 14 could also control the printing device so as to control the amounts being printed on the mail articles.

What is claimed is:

1. An apparatus for selecting articles of mail, comprising:

a printing device which prints a postage amount on a mail article;

an additional printing element which prints one of a plurality of selectable marks on said mail article, said plurality of selectable marks respectively identifying shipping services, the mark printed on said mail article by said additional printing element identifying a specific shipping service for said mail article; and an accounting device having a plurality of selectable registers corresponding to said shipping services and operating with said printing device and said additional printing element to account for said postage amount of said mail article in the register corresponding to said specific shipping service identified by said mark printed on said mail article.

2. The apparatus as claimed in claim 1, further comprising a keypad which controls the position of said additional printing element.

3. A device as claimed in claim 1, further comprising an element which positions the additional printing element proximate to the printing plates to cause the additional printing element to print the mark on the envelope proximate to the postage amount.

4. A device as claimed in claim 1, wherein the additional printing element is a pivoting printing plate in the print drum.

5. A device as claimed in claim 1, wherein the additional printing element is a print wheel in the print drum.

6. A device as claimed in claim 1, wherein the additional printing element is one of a hinged rocker and a cam shaft in the print drum.

* * * * *